US005565143A

United States Patent [19]

Chan

[11] Patent Number: 5,565,143

[45] Date of Patent: Oct. 15, 1996

[54] WATER-BASED SILVER-SILVER CHLORIDE COMPOSITIONS

[75] Inventor: Man-Sheung Chan, Chapel Hill, N.C.

[73] Assignee: E. I. Du Pont de Nemours and Company, Wilmington, Del.

[21] Appl. No.: 435,250

[22] Filed: May 5, 1995

[51] Int. Cl.[6] ..... H01B 1/22; H01B 1/20

[52] U.S. Cl. ..... 252/514; 252/518

[58] Field of Search ..... 252/514, 518, 252/511; 428/402, 425.9, 461, 469; 128/640

[56] References Cited

U.S. PATENT DOCUMENTS

| | | | |
|---|---|---|---|
| 3,617,387 | 11/1971 | Grulke et al. | 136/111 |
| 3,834,373 | 9/1974 | Sato | 128/2.06 |
| 4,454,007 | 6/1984 | Pace | 204/403 X |
| 4,699,146 | 10/1987 | Sieverding | 252/518 X |
| 4,772,377 | 9/1988 | Geist et al. | 204/415 |
| 4,848,348 | 7/1989 | Craighead | 428/425.9 X |
| 4,994,167 | 2/1991 | Shults et al. | 204/403 |
| 5,051,208 | 9/1991 | Bowns et al. | 252/511 |
| 5,207,950 | 5/1993 | Ehrreich | 252/518 |

FOREIGN PATENT DOCUMENTS 5-95922 4/1993 Japan .

*Primary Examiner*—Douglas J. McGinty

[57] ABSTRACT

The present invention relates to silver/silver chloride polymer compositions for use in making electrodes. The composition comprises:

(a) 3–15% water dispersible polymer wherein the polymer is an acrylic, urethane or blends;

(b) 25–95% Ag;

(c) 5–75% AgCl; and wherein (a), (b), and (c) are dispersed in water and at least 1% wt. organic co-solvent.

10 Claims, No Drawings

WATER-BASED SILVER-SILVER CHLORIDE COMPOSITIONS

FIELD OF THE INVENTION

This invention relates to polymeric compositions containing a water based polymeric binder, silver particles and silver chloride particles for use in making electrochemical and biomedical electrodes.

BACKGROUND OF THE INVENTION

Silver, silver chloride electrodes are widely used in electrochemical and biomedical applications. For instance, in EKG application, Ag/AgCl electrodes are used to detect very weak electrical responses from human hearts, and electrodes with high conductivity and low electrode polarization are desirable to achieve low noise and high signal sensitivity. Another application involves the use of Ag/AgCl electrodes in electrochemical applications, such as electrophoresis where a continuous electrical current is applied to facilitate the transport of charged particles. In such application Ag/AgCl electrodes allow the delivery of a continuous current at a low and steady voltage. Because of the ability of Ag/AgCl electrodes to maintain a constant and low standard electrode potential. Ag/AgCl is widely used as a reference electrode. Still another application is use as a biosensor. A biosensor consists of a biological component, typically in the form of a polymer membrane and a transducer that is structurally integrated to a biological component. The transducer converts the biological signal to a form of an electrical signal that can be measured directly or amplified further to produce analytical results. An Ag/AgCl electrode functions as a counter electrode vs an enzyme/platinum working electrode, when a stable electrode potential is important. All applications herein are based on the electrochemical characteristics of a Ag/AgCl electrode, namely, (a) low half-cell potential vs standard hydrogen electrode, (b) minimum electrode polarization, (c) stable electrode potential under a low current bias.

Conventional Ag/AgCl electrodes are manufactured in several ways, namely, (a) electrochemically treating silver foil to form a thin surface layer of silver chloride on silver foil, (b) forming Ag/AgCl disk electrodes by compaction of silver and silver chloride particles, and (c) coating of a silver/silver chloride polymer composition on a dielectric substrate. In the utilization of EKG electrodes or medical electrodes, the Ag/AgCl electrodes are further coated with a saline water-containing hydrogel which serves as an ionic conducting media and a skin adhesive for attachment to human skin.

Of the three methods described, the use of silver/silver chloride polymeric inks printed on plastic film substrates is particularly attractive from cost and performance standpoints. With polymeric inks, printing can be carried out by flexographic, gravure or screen printing processes to produce thin Ag/AgCl polymer coatings of 0.2–0.3 mil on plastic films, such as polyester, polycarbonate, polyvinyl chloride and the like. The coated film can then be stamped out into small pieces to make low-cost, disposable electrodes for EKG and other medical electrode applications.

Silver, silver chloride polymer compositions disclosed in the prior art are typically prepared by dispersing silver and silver chloride particles in solvent based polymer solutions. U.S. Pat. No. 5,051,208 discloses screen printable Ag/AgCl paste compositions with polyester or phenoxy resins as the polymeric binders. U.S. Pat. 5,207,950 discloses polymeric paste compositions with chloride silver particles. The Ag/AgCl polymer compositions disclosed by the art teach organic solvents as the printing vehicle. With increasingly stringent regulations aimed at reducing air emission of organic solvents from coating industries, there is a need for ink products with low volatile organic compounds (VOC). Water based Ag/AgCl ink is an attractive alternative to meet such a need. Further, needs exist to reduce cost of the disposable biomedical electrodes through more efficient usage of silver and silver chloride in the printing inks while improving the required electrochemical characteristics of these electrodes. It is the objective of the present invention to provide conductive polymeric coating compositions for biomedical and electrochemical electrodes that surpass emission standards and remedy the above mentioned shortcomings.

SUMMARY OF THE INVENTION

The present invention relates to silver/silver chloride polymer compositions for use in making electrodes. The composition comprises:

(a) 3–15% water dispersible polymer wherein the polymer is an acrylic, urethane or blends;

(b) 25–95% Ag;

(c) 5–75% AgCl; and wherein (a), (b), and (c) are dispersed in water and at least 1% wt. organic co-solvent.

DETAILS OF THE INVENTION

The present invention relates to conductive compositions comprising conductive silver particulate, silver chloride particulate, water dispersible polymeric binders and co-solvents. These conductive compositions may be used in printing silver/silver chloride coatings on plastic dielectric film substrates to make disposable electrodes for use in electrochemical and biomedical applications, such as electrocardiograph and blood sensors. These compositions are particularly suitable for printing on plastic film substrates by flexographic/gravure printing processes to further reduce manufacturing costs of biomedical electrodes.

Silver Component

The silver particles used in the present invention are finely divided particles, preferably in flake form, with a preferable particle size within the range of 0.1 micron to 15 microns. When referring to flake size measurement, the length of the largest dimension of the flake is measured. Silver particles with size less than 5 microns are more preferred for more efficient usage of silver and for achieving a very thin uniform coating by known printing processes. Fine silver flakes enhance the interfacial interactions between silver and silver chloride particulates when electrochemical reactions occur, and thus reducing electrode polarization and improving the efficiency of silver/silver chloride usage. However, larger silver particles with sizes greater than 15 microns can also provide acceptable properties. Silver-coated particles, such as Ag-coated mica or talc, can also be used as a substitute for pure silver particles to reduce material cost in applications where high electrical conductivity is not required. Typically, silver-coated particles with 50 weight percent or higher of silver coating are effective low-cost conductive fillers. To achieve good electrical conductivity, the loading of silver particles is set in the range of 25–95 percent by weight of dry coating. The preferred silver loading by weight of dry coating are in the range of 70–90 percent for EKG electrodes and 30–60 percent for electrophoretic and blood sensor electrodes.

Silver Chloride Component

The silver chloride component may be in powder form or a wet paste. The preferred particle size of the silver chloride is a range of 0.1 micron to 15 microns. A silver chloride powder, such as those commercially available from Colonial Metals Inc., DE or Metz Metallurgical Corporation, NJ, tend to agglomerate to form dry lumps which are difficult to disperse in liquid media by agitation. Therefore, milling and grinding in a suitable liquid medium are often needed to prepare fine dispersions of silver chloride. Alternatively, a wet paste of fine silver chloride precipitated from an aqueous solution can be added directly to a water based silver ink mixture to make Ag/AgCl inks. A proper balance of silver versus silver chloride is important to achieve the desired electrochemical characteristics of a silver/silver chloride electrode. For applications in electrochemical signal detections, electrodes with high conductivity and low electrode polarization are important, and a silver/silver chloride weight ratio in the range of 90/10 to 80/20 is preferred. In the cases where Ag/AgCl electrodes are used in a current carrying electrochemical cells, a silver/silver chloride weight ratio in the range of 80/20 to 25/75 is preferred. The typical silver chloride loading is 5–75 percent by weight of dry coating, and the preferred silver chloride loading by weight of dry coating are 5–25 percent for EKG and 25–75% for electrophoretic and blood sensor electrodes.

Polymer Binder Component

The polymeric binders used in the present invention are aqueous dispersions of acrylic or urethane polymers or blends thereof. The polymer binder is used within the range of 3–15% dry weight and with a preferred range of 8–10% dry weight. If less than 3% dry weight is used in the composition, the resulting film's integrity is compromised by affecting the film's cohesion. If greater than 15% dry weight is used in the composition, the resulting film's electrical conductivity diminishes. The polymers are hydrophilic polymers with pendant carboxylic acid groups on the polymer backbones or side chains. When neutralized with an organic base, such as alkyl amine, these carboxylic acid groups turn into alkyl ammonium carboxylate. When diluted with water, the polymer solutions turn into water based dispersions with polymer molecules converted into microscopic particles stabilized by surface ionic pendant groups.

Acrylic polymer dispersions used in this invention are aqueous branched polymers. The acrylic polymers are grafted copolymers prepared from ethylenically unsaturated monomers, such as alkyl esters or amide of acrylic acid or methacrylic acid, styrene, acrylonitrile or methacrylonitrile. The grafted copolymer has a linear polymer backbone with a molecular weight of 2,000–200,000 and side chains with a molecular weight of 1,000–30,000. Preferred molecular weights of the copolymers are 2,000–100,000 for the grafted copolymer and 1,000–20,000 molecular weight for the side chains. The grafted copolymer has a polymer backbone having hydrophilic carboxylic acid pendant groups partially neutralized with alkyl amine and side chains made up of hydrophobic monomers. The polymer backbone is preferably based on 2–30% by weight of methacrylic acid. This combination of a hydrophilic backbone and hydrophobic side chains imparts a good balance of good coating moisture resistance verses adequate hydrophilicity to facilitate the Ag/AgCl electrode reaction. When neutralized with an organic base and mixed with water, the dispersed polymer typically has average particle size of 10 to 1000 nm, preferably 20 to 400 nm. A preferred acrylic polymer dispersion suitable for this invention is an aqueous branched polymer dispersion described in DuPont U.S. patent application Ser. No. 08/184,525.

Another acrylic polymer dispersion suitable for use in this invention is an aqueous branched polymer dispersion described in U.S. Patent No. 5,231,131 which is incorporated herein as reference. The acrylic polymer is a grafted copolymer having hydrophobic backbone and side chains with hydrophilic carboxylic acid pendant groups. Preferred molecular weights are 40,000–150,000 for the grafted polymer and 1000–7000 for the side chains. Such a grafted polymer is prepared from an acrylic macromonomer with hydrophilic pendant carboxylic groups and acrylic monomers.

Polyurethanes used in the present invention include any polyurethane that is water dispersible. These are hydrophilic polyurethanes with ionic groups (e.g., hydrophilic moieties) on the polymer backbone having hydrophilic carboxylic acid pendant groups which are neutralized with alkyl amines. Exemplary polyurethanes and their dispersions are illustrated in the Dieterich article "Aqueous Emulsions, Dispersion and Solutions of Polyurethanes; Synthesis and Properties" in Progress in Organic Coatings, Vol. 9, pp. 281–340 (1981). The preferred polyurethane dispersion used in the present invention are carboxylated aliphatic polyester, polyether urethanes. This polyurethane has pendant carboxylic acid groups on a polymer chain. When reacted with an organic base, such as an alkyl amine, the pendant groups are converted into alkyl ammonium carboxylate groups and the polyurethane polymer turns into fine polymer particles dispersible in water. These polyurethane dispersions are commercially available from Zeneca Corporation under the NeoRez® trademark. Other suitable polyurethane dispersions are available from Mobay Corporation.

Blends of the above mentioned acrylic and urethane aqueous dispersions are suitable binders for the silver—silver chloride coating compositions covered in the present invention. The urethane to acrylic ratio in the range of 0 to 1 by weight of polymer solids. The preferred blend is in the range of 0.1 to 0.5.

The use of polymer binders with hydrophilic pendant groups provides unique advantages over conventional solvent based Ag/AgCl inks. First, these carboxylic acid pendant groups on the polymer backbone or side chains provide stabilization for polymer particles and reduce the settling of silver and silver chloride particles. Secondly, the presence of these hydrophilic pendant groups in the polymer matrix improves the ion transport through the Ag/AgCl polymer coating. The improved ion transport, particularly chloride ion transport, can lead to low electrode polarization, thus minimizes electrochemical signal distortion for EKG electrodes.

The above mentioned acrylic or urethane dispersions can also be blended with an acrylic latex with less than 50 percent by weight of polymer solids to provide a water based binder resin for silver—silver chloride ink compositions. Common acrylic latex resins are commercially available from Rohm & Hass Company under the trademark of Roplex® and from BF Goodrich Company under the trademark of Carboset®.

The above mentioned water based binders can be modified with an optional crosslinker that reacts with the carboxylate groups on the acrylic and urethane polymers. The crosslinked polymers provide improved coating hardness to the Ag/AgCl coating. Water soluble crosslinking agents suitable for such crosslinking reactions are from the families of aziridine and melamine formaldehyde.

A small amount between 1–10% wt. of co-solvent is included in the water based ink composition. The preferred composition has 3–6% wt. of co-solvent. These co-solvents function as coalescent agents for polymer particles to aid the film-forming process during drying, and also serve as wetting agents and adhesion promoters on plastic film surfaces. Examples of co-solvents come from the families of glycols such as ethylene, propylene glycol or the like; mono and dialkyl-ethers of ethylene or propylene glycol widely marketed as Cellosolve® from Union Carbide, CT and as Arcosolve® from ARCO Chemicals, PA and Dowanol® from DOW, MI, and the family of alkanols such as pentanol and hexanol.

The solid components of the composition is dispersed in water. The amount of water must be sufficient to provide good rheology qualities and suitable consistency for the method of application. The main purpose of the water is to serve as a vehicle for dispersion of the solids of the composition in such a form that it can readily be applied to a substrate. Deionized or distilled water is preferred for use in the composition. The water deionized or distilled insures dispersion and stability to the composition by reducing any ionic contribution from the water.

Surfactants are often added to water based dispersions of silver and silver chloride particles to maintain dispersion stability for storage and processing. Anionic surfactants from the families of long-chain aliphatic carboxylic acid and their salt such as oleic acid and sodium stearate, nonionic surfactants from the families of alkyl polyether alcohol widely marketed as Triton* and Tergital* from Union Carbide, CT. are suitable for the compositions in this invention.

Water soluble or water dispersible polymeric thickening agents are often added to raise the viscosity. Common water soluble polymers such as polyacrylamide, polyacrylic acid, polyvinylpyrrolidonevinyl acetate copolymer, polyvinyl alcohol, polyethylene-oxide and swellable acrylic dispersion widely marketed as Acrysol*, from Rohm-Hass PA are suitable for the compositions in this invention.

A composition of the present invention can be applied as a thin coating on a dimensionally stable dielectric film substrate by a flexographic/gravure printing process. Film substrates suitable for making low cost disposable medical electrodes are plastic films in the families of polyesters, polyvinyl chloride, polycarbonate and the like. Low-cost disposable medical electrodes can also be made with a very thin Ag/AgCl coating on a conductive carbon undercoating applied on a film substrate or a conductive carbon-filled plastic sheet.

General Composition Preparation and Printing Procedures

Water-based Ag/AgCl ink is typically prepared by milling and grinding silver chloride powder in a blend of acrylic and urethane dispersion. The resulting silver chloride dispersion is then blended with additional water based polymer binder resin and silver flakes under vigorous agitation to thoroughly disperse the silver flakes.

For use in disposable EKG electrodes, a thin coating of silver—silver chloride conductive ink is applied on a dimensionally stable dielectric film substrate. The typical silver—silver chloride coating will have a thickness less than 0.3 mil with the resulting coat weight being less than 1.2 milligram/sq. cm. The preferred film substrates for EKG electrodes are plastic films from the families of copolyester, polycarbonate, and polyetherimide polyvinylchloride films. In some applications a very thin silver—silver chloride coating (<0.1 mil) printed on a conductive carbon-filled polyvinylchloride film or a polyester film with a conductive-carbon ink coating can be used to further reduce the electrode cost. In yet another application, a very thin (<0.1 mil) Ag-AgCl coating can be printed on a silver conductive coating to provide electrodes with very high conductivity. Printing of a silver—silver chloride ink is preferably carried out on a flexographic or gravure printing press. These processes allow for the production of very thin continuous uniform coatings with multiple prints at high throughput and low manufacturing cost.

A flexographic or gravure printing press consists of multiple coating heads, a web handling assembly and a long drier. Each coating head, which is part of an assembly of a coating pan, an assembly of rollers and a short drying oven, provide one print on a plastic film web. In a typical coating run, ink liquid is loaded into the coating pan. A wet coating of ink is picked up by the rolling gravure or fountain roll which dips in the ink in the coating pan. As the rolling gravure roll presses on the moving web of plastic film which wraps around the impression roll, the wet coating is transferred onto the plastic film. The flexographic method picks up the ink by an engraved roll, which the ink is then transferred onto a rubber roll with the printing pattern which in turn is printed onto a moving film substrate. The coating on the moving film web is dried to a tack-free state in the short oven. Multiple prints are repeated on the multiple printing heads to provide the targeted coating thickness. The web finally passes through the long drier to fully dry the coating. To achieve consistent coating quality, it is important to optimize coating parameters, such as coating thickness, web speed, oven temperature, and air flow rate. If dilution of the ink is needed, the coating parameters should be adjusted accordingly to match changes in ink properties, such as % solids, viscosity, and solvent drying rate. For water-based inks, care should also be taken to avoid foaming when ink is circulated to the coating pan by pumping.

EXAMPLES

Example 1

This example demonstrates the preparation of a water based Ag/AgCl ink using an aqueous branched polymer ABP resin RCP-20355 from E. I. Du Pont de Nemours and Co., Wilmington, DE, which has a hydrophilic backbone comprising of methyl methacrylate/styrene/butylacrylate/methacrylic acid and hydrophobic side chains comprising of ethylhexyl methacrylate/hydroxyethylate methacrylate/butyl acrylate. Typical molecular weight of the grafted polymer is 50,000–70,000 with side chain molecular weight of 1000–2000. A water based silver chloride dispersion (A) was prepared according to the following procedure. To a 2 gallon container the following ingredients were added while mixing: 498 grams of aqueous branched polymer (ABP) resin RCP-20355, 49.5 grams of deionized water, 44.5 grams of propylene glycol monopropyl ether (commercially available as Arcosolve® PNP from ARCO Chemicals Corporation), 49.5 grams of 5% ammonia solution, and 15.3 grams of Acrysol ASE-60 thickening agent (Rohm and Hass Company). After mixing for 10 minutes, the following ingredients were added while mixing: 799.5 grams of deionized water, 88.2 grams of Arcosolve® PNP, 49.5 grams of Butyl Cellosolve®, 182.7 grams of polyurethane dispersion NeoRez R-9699 (ZENECA Inc.), and 19.2 grams of Acrysol® ASE-60. The resin sample and 1200 grams of silver chloride powder (Colonial Metals Inc.) were added to a jar mill with ceramic grinding media. The sample was milled to a fine grind reading on a Hegmen gauge of 7(<0.25 mil).

A silver—silver chloride conductive ink composition with an Ag/AgCl weight ratio of 80/20 was prepared using the following procedure. To a two-gallon plastic container was added with mixing the following ingredients: 1408.7 grams of aqueous branched polymer resin RCP-20355, 1121.6 grams of deionized water, 156.6 grams of Arcosolve® PNP, 130.5 grams of 5% ammonia solution, 39.2 grams of Acrysol® ASE-60, and the mixture was mixed for 10 minutes. 130.5 grams of Butyl Cellosolve® and 4369.4 grams of fine silver flake with a 50% flake diameter (D50) of 5 microns was added while mixing, then mixture was mixed with vigorous agitation for 20 minutes. D50 as used herein is a diameter where 50% of the silver particles are smaller and 50% are larger. 2712.9 grams of silver chloride dispersion (A) and 210.5 grams of methyl n-amyl ketone were added while mixing. The final viscosity of the ink sample was 30–40 seconds in a #2 Zahn cup at 60% solids. The sample was found to have excellent settling characteristics with no observable settling of silver flakes after standing for 24 hours.

Example 2

This example illustrate the use of large silver flakes in a Ag/AgCl ink formulation. An ink composition was prepared the same way as Example 1 except using a large silver flake with D50 of 14 microns instead of the fine silver flake.

Example 3

This example illustrates ink formulation with a Ag/AgCl weight ratio of 87/13. A water based silver ink composition (B) was prepared by mixing the following ingredients: 41.6 grams of ABP resin, 37.7 grams of deionized water, 5.4 grams of Arcosolve® PNP, 3.9 grams of 5% ammonia solution, 3.4 grams of Butyl Cellosolve, 120 grams of fine silver flakes and 3.9 grams of methyl n-amyl ketone.

A Ag/AgCl ink composition with Ag/AgCl weight ratio of 87/13 was prepared by mixing the following ingredients: 20.0 grams of Ag/AgCl ink from Example 1, 10 grams of Ag ink (B), 6.7 grams of deionized water and 1.3 grams of Arcosolve® PNP.

Example 4

This example illustrates the preparation of a Ag/AgCl ink composition using a branched polymer resin RCP-21383 from E. I. du Pont de Nemours and Company which has a hydrophobic backbone comprising of butyl acrylate/methyl methacrylate/hydroxyethyl methacrylate/styrene and hydrophilic side chains comprising of methacrylic acid/hydroxyethyl methacrylate/butyl methacrylate/methyl methacrylate. Typical molecular weight of this branched polymer is in the range of 100,000-150,000 and side chain molecular weight of 6,000-7,000.

RCP-21383 is an acetone solution of the branched polymer at 40% solids. To convert RCP-21383 into a water based resin, 87 grams of RCP-21383 was mixed with 15 grams of Butyl Cellosolve® and 30 grams of Arcosolve® PNP. 45 grams of acetone solvent were removed by distillation. The remaining resin was neutralized with 0.8 grams of triethylamine and then 87 grams of deionized water were added dropwise with vigorous mixing. The final water based resin (C) was a milky dispersion.

A Ag/AgCl ink composition was prepared by mixing 24.6 grams of AgCl dispersion (A) in example 1, 4.0 grams of water based resin (C), 3.1 grams of deionized water, 18.6 grams of silver flake with D50 of 5 um and 0.7 grams of methyl n-amyl ketone.

Example 5

An ink formulation with increased solids loading for thick printing was prepared in a similar way as example 1 with polyvinylpyrrolidone-vinyl acetate copolymer (W-735, GAF Corporation, NJ) replacing Acrysol ASE-60. A silver chloride dispersion (D) was prepared by milling in a jar mill the following ingredients: 64 grams of silver chloride powder and 96 grams of resin mixture which contains 30% of ABP resin, 48.8% of deionized water, 10.3% of Arcosolve PNB, 0.7% of 20% ammonia solution and 10.1% of NeoRez R. An ink sample was prepared by mixing the following ingredients: 16.7 grams of ABP resin, 3.3 grams of Arcosolve* PNP, 0.15 grams of 20% ammonia solution, 1.2 grams polyvinyl pyrrolidone-vinyl acetate copolymer (W735 from GAF, NJ), 49.9 grams of silver flake, 31 grams of dispersion (D) and 2.0 grams of methyl amyl ketone. The ink sample has 67% solids and a viscosity of 34 seconds @ 2 Zahn cup.

Example 6

This example illustrates the preparation and testings of silver—silver chloride coatings for making EKG electrodes.

The coating of ink samples were prepared using the compositions of Examples 1, 2, 3 and 4. Samples were prepared by doing a drawdown on a sheet of 5 mil print treated polyester film. A wire-wound drawdown rod with #8 wire was used to produce a 0.2 mil dry coating. The coated sample was dried at 70 C. for 10 minutes.

A sample of example 1 was also coated on a flexographic printing press. A 0.15 mil coating with a coat weight of 0.7 milligram/cm$^2$ was produced using 400-line engraved cylinder printed four times.

A sample of example 1 was also printed on a gravure printing press. A 0.2 mil coating with a coat weight of 0.9 milligram/cm$^2$ was produced using a 300-line engraved cylinder printed three times.

These coated samples were tested according to Test Procedure AAMIEG-12, using a Xtratech electrode tester available from Omnica of Tustin, CA. The electrode properties are shown in Table 1.

TABLE 1

| | | DC | | Simulated Recovery | |
|---|---|---|---|---|---|
| Example | Thickness (mil) | Offset Voltage (mvolt) | AC Impedence (30 sec;ohm) | Offset Voltage (mvolt) | Rate (mvolt/s) |
| 1 (b) | 0.15 | 0.6 | 69 | 13.5 | 0.3 |
| 1 (c) | 0.2 | 0.6 | 37 | 14.2 | 0.5 |
| 1 (a) | 0.2 | 0.6 | 31.3 | 13.8 | 0.35 |
| 2 (a) | 0.25 | 0.5 | 74 | 15 | 0.5 |
| 3 (a) | 0.3 | 0.6 | 52 | 26 | 0.7 |
| 4 (a) | 0.3 | 0.3 | 46 | 12.3 | 0.4 |

TABLE 1-continued

| Example | Thickness (mil) | DC Offset Voltage (mvolt) | AC Impedence (30 sec;ohm) | Simulated Recovery Offset Voltage (mvolt) | Simulated Recovery Rate (mvolt/s) |
|---|---|---|---|---|---|
| 5 (a) | 0.2 | 0.2 | 61 | 14.2 | 0.3 |
| AAMI Limits | | <100 | <2000 | <100 | |

(a) Drawdown sample
(b) Flexographic printed sample
(c) Gravure printed sample

Example 7

This example demonstrates the preparation of an ink formulation with an Ag/AgCl ratio of 60/40 which is suitable for use as a cathode in a current carrying electrochemical cell. The ink was prepared in the same way as Example 5 by mixing the following ingredients: 10.0 grams of ABP resin, 1.0 gram of Arcosolve* PNP, 2.0 grams of propylene glycol n-butyl ether (commercially available as Arcosolve* PNB, ARCO Chemicals, PA), 50 grams of dispersion (D) in Example 5 and 2 grams of methyl amyl ketone.

Example 8 (Comparative)

A solvent based Ag/AgCl ink with an Ag/AgCl weight ratio of 80/20 was prepared and served as a comparison against the water based ink in Example 1.

An AgCl dispersion (E) was prepared by milling for six hours in a jar mill using the following ingredients: 23.5 grams of silver chloride powder, 6.7 grams of acrylic resin Elvacite* 2016 (ZENECA, DE) dissolved in 49 grams of n-propyl acetate, and 0.1 grams of oleic acid.

An Ag/AgCl ink composition was prepared by mixing 30 grams of dispersion (E) and 35.4 grams of silver flake.

Example 9 (Comparative)

A solvent based Ag/AgCl with an Ag/AgCl ratio of 60/40 was prepared in the same way as Example 8 by mixing 40 grams of dispersion (E) and 17.7 grams of silver flake.

Example 10

This example demonstrates the current carrying capacity of Ag/AgCl electrodes made from different Ag/AgCl inks. In a current carrying electrochemical cell, Ag/AgCl electrodes undergo electrochemical reactions induced by the transfer of electrons. When a constant current is applied to the cell, electrons are transferred to the cathode and silver chloride is reduced into silver and chloride, and simultaneously electrons are removed at the anode with silver converted into silver chloride. Ag/AgCl coatings with high AgCl content, such as (ii) and (iv) below, are good for use as cathode, and Ag/AgCl coatings with high Ag content, such as (i) and (iii) below, are desirable for use as anode. The capacity of Ag/AgCl electrodes to sustain the constant current is a key property for their usefulness in this type of application. One measure of the capacity is the time the electrodes can sustain a constant electrical current in an electrochemical cell. Ag/AgCl coatings on a 3 mil polyester film substrate were prepared from the following inks using a #12 wire wound drawdown rod and then dried at 70° C. for 5 minutes. Typical coating thickness is (i) water based ink with 80/20 Ag/AgCl in Example 1
(ii) water based ink with 60/40 Ag/AgCl in Example 5
(iii) solvent based ink with 80/20 Ag/AgCl in Example 8
(iv) solvent based ink with 60/40 Ag/AgCl in Example 9
(v) solvent based Ag/AgCl ink (5524639) from Acheson Corp.

These samples were tested for current carrying capacity in an electrochemical cell using the procedure described below. 1 cm × 4 cm pieces of Ag/AgCl coating were mounted as a cathode or an anode with 2 cm submerged in a 0.15 M NaCl solution. The electrodes were connected to a constant current generator at 2 mA current. The potential across the cathode and anode is monitored with a voltmeter vs. time. Typically, the potential remained in the range of 0.17 to 0.25 volt until either Ag was depleted at the anode or AgCl was depleted at the cathode by the reversible electrochemical reaction Ag + Cl−=AgCl + e., then the potential rised quickly to exceed 1 volt. The relative capacity was measured as the time the electrodes can maintain low EMF < 1 volt.

| Cathode/Anode | Capacity (seconds) |
|---|---|
| i/i | 250 |
| ii/ii | 140 |
| iii/iii | 140 |
| iv/iv | 10 |
| ii/i | 450 |
| ii/v | 150 |
| iv/iii | 410 |

As one can see electrodes made from water based inks have better capacity than those made from solvent based inks.

What is claimed is:

1. A conductive composition consisting essentially of based on dry weight:

(a) 3–15% water dispersible polymer material with an acrylic polymer which is a grafted co-polymer with a polymer backbone having hydrophilic carboxylic acid pendant groups neutralized with alkyl amine and optionally polyurethane;

(b) 25–95% Ag;

(c) 5–75% AgCl; and wherein (a), (b), and (c) are dispersed in water and at least 1% wt. organic co-solvent.

2. The composition of claim 1 wherein the weight ratio of Ag/AgCl has a range of 90/10 to 25/75.

3. The composition of claim 1 wherein the Ag is in the form of flake particles.

4. The composition of claim 1 wherein the urethane to acrylic ratio is in the range of 0 to 1 by weight of polymer solids.

5. The composition of claim 1 wherein the acrylic polymer is dispersed in water.

6. The composition of claim 1 further comprising a water soluble crosslinking agent.

7. The composition of claim 6 wherein the crosslinking agent is aziridine or melamine formaldehyde.

8. The composition of claim 1 wherein the co-solvent is within the range of 1–10%.

9. The composition of claim 1 wherein the Ag has a particle size range of 0.1 micron to 15 microns.

10. The composition of claim 1 wherein the AgCl has a particle size range of 0.1 micron to 15 microns.

* * * * *